US006679746B2

(12) United States Patent
Kai et al.

(10) Patent No.: US 6,679,746 B2
(45) Date of Patent: Jan. 20, 2004

(54) METHOD FOR PRODUCING DISCHARGE LAMP AND DISCHARGE LAMP

(75) Inventors: Makoto Kai, Katano (JP); Makoto Horiuchi, Sakurai (JP); Tomoyuki Seki, Takatsuki (JP); Tsuyoshi Ichibakase, Takatsuki (JP); Mamoru Takeda, Soraku-gun (JP); Shinichi Yamamoto, Hirakata (JP); Kenichi Sasaki, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 202 days.

(21) Appl. No.: 09/891,785

(22) Filed: Jun. 25, 2001

(65) Prior Publication Data

US 2002/0000776 A1 Jan. 3, 2002

(30) Foreign Application Priority Data

Jun. 26, 2000 (JP) ..... 2000-191452

(51) Int. Cl.[7] ..... H01J 17/20; H01J 61/12; H01J 9/00; H05B 33/10

(52) U.S. Cl. ..... 445/26; 313/574

(58) Field of Search ..... 445/26, 39, 46; 313/574

(56) References Cited

U.S. PATENT DOCUMENTS

| | | | | |
|---|---|---|---|---|
| 4,508,514 A | * | 4/1985 | English | 445/26 |
| 4,757,427 A | | 7/1988 | Oostvogels et al. | 362/32 |
| 4,997,400 A | | 3/1991 | Neff et al. | 445/26 |
| 6,132,279 A | * | 10/2000 | Horiuchi et al. | 445/26 |
| 6,135,840 A | * | 10/2000 | Kanzaki | 445/26 |
| 6,375,533 B1 | * | 4/2002 | Torikai et al. | 445/26 |

FOREIGN PATENT DOCUMENTS

| | | | | |
|---|---|---|---|---|
| EP | 0866488 A1 | | 9/1998 | H01J/9/32 |
| EP | 0 910 111 A2 | | 4/1999 | H01J/61/82 |
| EP | 1 089 322 A1 | | 4/2001 | H01J/61/86 |
| JP | 11-40058 | | 6/1989 | H01J/9/28 |
| JP | 06310030 A | | 11/1994 | H01J/9/02 |
| JP | 06310030 | | 11/1994 | H01J/9/02 |
| JP | 07045237 A | | 2/1995 | H01J/61/73 |
| JP | 07 045237 a1 | * | 2/1995 | H01J/61/73 |
| JP | 09069353 A | | 3/1997 | H01J/61/73 |
| JP | 09 069353 a1 | * | 3/1997 | H01J/61/73 |
| JP | 10055757 A | | 2/1998 | H01J/9/02 |
| JP | 2000057995 A | | 2/2000 | H01J/61/73 |

* cited by examiner

*Primary Examiner*—Sandra O'Shea
*Assistant Examiner*—Peter Macchiarolo
(74) *Attorney, Agent, or Firm*—Harness, Dickey & Pierce, P.L.C.

(57) ABSTRACT

A method for producing a discharge lamp of the present invention includes the steps of: preparing a glass pipe for a discharge lamp having a luminous bulb portion and a side tube portion, and a single electrode assembly including an electrode structure portion that will be formed into a pair of electrodes of the discharge lamp; inserting the single electrode assembly into the glass pipe for a discharge lamp such that the electrode structure portion of the single electrode assembly is positioned in the luminous bulb portion of the glass pipe for a discharge lamp; forming a luminous bulb in which the electrode structure portion is arranged inside by attaching the side tube portion of the glass pipe for a discharge lamp to a part of the single electrode assembly; and forming a pair of electrodes in the luminous bulb by melting and cutting a part of the electrode structure portion selectively.

16 Claims, 5 Drawing Sheets

PRIOR ART

PRIOR ART

METHOD FOR PRODUCING DISCHARGE LAMP AND DISCHARGE LAMP

BACKGROUND OF THE INVENTION

The present invention relates to a discharge lamp and a lamp unit. In particular, the present invention relates to a discharge lamp and a lamp unit used as the light source of an image projection apparatus such as a liquid crystal projector or a digital micromirror device (DMD) projector.

In recent years, an image projection apparatus such as a liquid crystal projector or a projector using a DMD has been widely used as a system for realizing large-scale screen images. A high-pressure discharge lamp having a high intensity has been commonly and widely used in such an image projection apparatus. For the light source used in the image projection apparatus, light is required to be concentrated on an imaging device included in the optical system of the projector, so that in addition to high intensity, it is also necessary to achieve a light source close to a point light source. Therefore, a short arc ultra high pressure mercury lamp that is closer to a point light and has a high intensity has been noted widely as a promising light source.

Referring to FIG. 4, a conventional short arc ultra high pressure mercury lamp 1000 will be described. FIG. 4 is a schematic view of an ultra high pressure mercury lamp 1000. The lamp 1000 includes a substantially spherical luminous bulb 110 made of quartz glass, and a pair of sealing portions (seal portions) 120 and 120' also made of quartz glass and connected to the luminous bulb 110.

A discharge space 115 is inside the luminous bulb 110. A mercury (in an amount of, for example, 150 to 250 mg/cm$^3$) as a luminous material, a rare gas (e.g., argon with several tens kPa) and a small amount of halogen are enclosed in the discharge space 115. A pair of tungsten electrodes (W electrode) 112 and 112' are opposed with a certain electrode distance D (e.g., about 1.5 mm) in the discharge space 115. Each of the W electrodes 112 and 112' includes an electrode axis (W rod) 116 and a coil 114 wound around the head of the electrode axis 116. The coil 114 has a function to reduce the temperature at the head of the electrode.

The electrode axis 116 of the W electrode 112 is welded to a molybdenum foil (Mo foil) 124 in the sealing portion 120, and the W electrode 112 and the Mo foil 124 are electrically connected by a welded portion where the electrode axis 116 and the Mo foil 124 are welded. The sealing portion 120 includes a glass portion 122 extending from the luminous bulb 110 and the Mo foil 124. The glass portion 122 and the Mo foil 124 are attached tightly so that the airtightness in the discharge space 115 in the luminous bulb 110 is maintained. In other words, the sealing portion 120 is sealed by attaching the Mo foil 124 and the glass portion 122 tightly for foil-sealing. The sealing portions 120 have a substantially circular cross section, and the rectangular Mo foil 124 is disposed in the center of the inside of the sealing portion 120.

The Mo foil 124 of the sealing portion 120 includes an external lead (Mo rod) 130 made of molybdenum on the side opposite to the side on which the welded portion is positioned. The Mo foil 124 and the external lead 130 are welded to each other so that the Mo foil 124 and the external lead 130 are electrically connected at a welded portion 132. The configurations of the W electrode 112' and sealing portion 120' are the same as those of the W electrode 112 and sealing 120, so that description thereof will be omitted.

Next, the operational principle of the lamp 1000 will be described. When a start-up voltage is applied to the W electrodes 112 and 112' via the external leads 130 and the Mo foils 124, discharge of argon (Ar) occurs. Then, this discharge raises the temperature in the discharge space 115 of the luminous bulb 110, and thus the mercury is heated and evaporated. Thereafter, mercury atoms are excited and become luminous in the arc center between the W electrodes 112 and 112'. The higher the mercury vapor pressure of the lamp 1000 is, the higher the emission efficiency is, so that a lamp having a higher mercury vapor pressure is more suitable as a light source for an image projection apparatus. However, in view of the physical strength against pressure of the luminous bulb 110, the lamp 1000 is used at a mercury vapor pressure of 15 to 25 MPa.

The conventional lamp 1000 is produced in the manner as shown in FIGS. 5A to 5C. FIGS. 5A to 5C are cross-sectional views showing a production process sequence of a method for producing the lamp 1000.

First, a glass pipe 150 for a discharge lamp having a luminous bulb portion 110 that will be formed into the luminous bulb of the lamp 1000 and a side tube portion (sealing portion) 122 that will be formed into the sealing portion of the lamp 1000, and an electrode assembly 140 in which the electrode 112 is joined to one end of the metal foil (Mo foil) 124 and the external lead 130 is joined to the other end are prepared. Then, as shown in FIG. 5A, the electrode assembly 140 is inserted in the glass pipe 150 for a discharge lamp (electrode assembly insertion process).

Next, as shown in FIG. 5B, when the pressure in the glass pipe 150 is reduced (e.g., less than 1 atmospheric pressure), and the glass tube 122 of the glass pipe 150 is heated and softened with, for example, a burner 54, so that the side tube portion 122 and the Mo foil 124 are attached tightly, thereby forming the sealing portion 120 (sealing portion formation process).

The same processes as those shown in FIGS. 5A and 5B are performed to the other side tube portion. More specifically, another electrode assembly 140 is inserted into a side tube portion that has not been formed into a sealing portion yet. At this time, the electrode assembly 140 is inserted while being aligned with the electrode 112 of the already-sealed electrode assembly 140 in such a manner that the pair of electrodes are on the same axis as much as possible and a predetermined electrode distance D is achieved. Thereafter, the sealing portion formation process is performed.

In this manner, when the sequence of the electrode assembly insertion process and the sealing portion formation process is performed twice, the luminous bulb 110 in which the pair of electrodes 112 are arranged in the discharge space 115 sealed with the pair of sealing portions 120 can be formed, as shown in FIG. 5C. Thus, the lamp 1000 can be produced. The luminous material enclosed in the discharge space 115 can be introduced into the luminous bulb 110 after one sealing portion 120 is formed and before the other sealing portion 120 is formed.

The electrode distance D of the lamp 1000 is a very important design matter that defines the arc length of the discharge lamp. When the electrode distance D of the lamp 1000 is short, a discharge lamp serving as a light source closer to a point light source and having higher intensity can be realized. However, the inventors of the present invention found that there are limitations of the conventional production method regarding further reduction of the electrode distance D. More specifically, the inventors of the present invention found limitations in the production process as follows. In the conventional production method, it is necessary to define the electrode distance D in the electrode assembly insertion process shown in FIG. 5A, so that the electrode distance D cannot be defined with a higher precision than that of the alignment in the electrode assembly insertion process.

Since the electrode assembly 140 has a configuration where the W rod 116 and the external lead 130 are joined to ends of a thin Mo foil 124 (e.g., a thickness of about 20 to 30 $\mu$m), it is difficult to improve the alignment precision because of the small thickness of the Mo foil 124. Therefore, when the lamp 1000 is produced by the conventional production method, the short arc lamp 1000 that can be obtained has an electrode distance D of about 1.5 mm to 1.2 mm at best, and it is technically very difficult to realize a short arc lamp 1000 having a distance D between the electrodes shorter than that.

SUMMARY OF THE INVENTION

Therefore, with the foregoing in mind, it is a main object of the present invention to provide a method for producing a discharge lamp that can define the electrode distance between a pair of electrodes with high precision.

A method for producing a discharge lamp of the present invention includes the steps of: preparing a glass pipe for a discharge lamp having a luminous bulb portion and a side tube portion, and a single electrode assembly including an electrode structure portion that will be formed into a pair of electrodes of the discharge lamp; inserting the single electrode assembly into the glass pipe for a discharge lamp such that the electrode structure portion of the single electrode assembly is positioned in the luminous bulb portion of the glass pipe for a discharge lamp; forming a luminous bulb in which the electrode structure portion is arranged inside by attaching the side tube portion of the glass pipe for a discharge lamp to a part of the single electrode assembly; and forming a pair of electrodes in the luminous bulb by melting and cutting a part of the electrode structure portion selectively.

It is preferable that the electrode structure portion has a configuration in which the pair of electrodes of the discharge lamp are on the same axis.

In one embodiment of the present invention, the method for producing a discharge lamp further includes the step of filling a luminous material into the luminous bulb portion of the glass pipe for a discharge lamp.

In one embodiment of the present invention, the method for producing a discharge lamp further includes the step of filling halogen or halogen precursor into the luminous bulb portion, wherein after melting and cutting the part of the electrode structure portion, the step of cleaning the inside of the luminous bulb in which the pair of electrodes are formed is performed by the halogen or halogen derived from the halogen precursor.

In one embodiment of the present invention, the step of cleaning the inside of the luminous bulb includes the step of vacuum-baking the luminous bulb to cause halogen cycles with the halogen.

It is preferable that the single electrode assembly includes a single tungsten rod serving as the electrode structure portion and metal foils joined to both ends of the single tungsten rod.

It is preferable that coils are wound around both sides of a part of the single tungsten rod that is to be melted and cut selectively.

It is preferable that the step of forming the pair of electrodes is performed by irradiation of laser light from the outside of the luminous bulb.

It is preferable that the irradiation of the laser light is performed by rotating the luminous bulb portion relatively.

The step of forming the pair of electrodes may be performed by allowing current to flow through the single electrode assembly.

It is preferable that the step of forming the pair of electrodes is performed while cooling the luminous bulb.

It is preferable that the step of forming the pair of electrodes is performed while cooling the portions that will be formed into the base portions of the pair of electrodes when the electrode structure portion is formed into the pair of electrodes.

In one embodiment of the present invention, the step of attaching the side tube portion to a part of the single electrode assembly includes the step of preliminarily attaching the side tube portion to the part of the electrode assembly such that a gap is generated between the electrode structure portion and the side tube portion, and after the step of the preliminary attachment, the part of the electrode structure portion is melted and cut selectively.

It is preferable that the gap has a length that can prevent the electrode structure portion from being in contact with the side tube portion, even if the electrode structure portion is expanded by heat during melting and cutting.

In one embodiment of the present invention, the method for producing a discharge lamp further includes the step of melting and cutting the part of the electrode structure portion selectively and then adjusting an electrode distance between the pair of electrodes obtained by melting and cutting, after the step of the preliminary attachment.

In one embodiment of the present invention, the method for producing a discharge lamp further includes the step of attaching a part of each of the pair of electrodes to the side tube portion so as to fill the gap, after the part of the electrode structure portion is melted and cut selectively.

According to another aspect of the present invention, a discharge lamp includes a luminous bulb in which a luminous material is enclosed and a pair of electrodes are opposed to each other in the luminous bulb; and a pair of sealing portions for sealing a pair of metal foils electrically connected to the pair of electrodes, respectively. The discharge lamp is produced by a method including the steps of preparing a glass pipe for a discharge lamp having a luminous bulb portion and a side tube portion, and a single electrode assembly including an electrode structure portion that will be formed into a pair of electrodes of a discharge lamp; inserting the single electrode assembly into the glass pipe for a discharge lamp such that the electrode structure portion of the single electrode assembly is positioned in the luminous bulb portion of the glass pipe for a discharge lamp; forming a luminous bulb in which the electrode structure portion is arranged inside by attaching the side tube portion of the glass pipe for a discharge lamp to a part of the single electrode assembly; and forming a pair of electrodes in the luminous bulb by melting and cutting a part of the electrode structure portion selectively, wherein an electrode distance between the pair of electrodes is 1 mm or less.

In the present invention, a part of the electrode structure portion of the electrode assembly is melted and cut selectively to form a pair of electrodes in the luminous bulb. Therefore, the distance between the pair of electrodes can be defined with a higher precision than that in the prior art. As a result, a discharge lamp having a shorter electrode distance (e.g., 1 mm or less, preferably 0.8 mm or less) that could not be realized in the prior art can be produced.

This and other advantages of the present invention will become apparent to those skilled in the art upon reading and understanding the following detailed description with reference to the accompanying figures.

DETAILED DESCRIPTION OF THE INVENTION

Figure 1A:
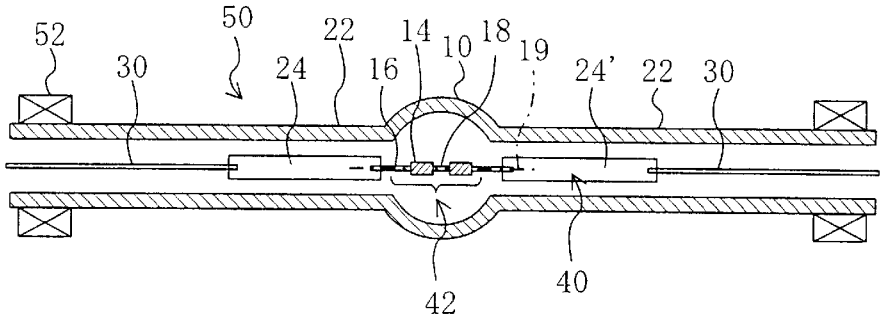
FIGS. 1A to 1D are cross-sectional views for illustrating a method for producing a discharge lamp of Embodiment 1.

Hereinafter, embodiment of the present invention will be described with reference to the accompanying drawings. In the following drawings, for simplification, the elements having substantially the same functions bear the same reference numeral. FIGS. 1A to 1D are cross-sectional views illustrating a method for producing a discharge lamp of this embodiment.

First, as shown in FIG. 1A, a glass pipe 50 for a discharge lamp and a single electrode assembly 40 including an electrode structure part 42 that will be formed into a pair of electrodes of the discharge lamp are prepared, and then the electrode assembly 40 is inserted into the glass pipe 50 (electrode assembly insertion process).

The prepared glass pipe 50 for a discharge includes a substantially spherical luminous bulb portion 10 that will be formed into a luminous bulb of the discharge lamp and a side tube portion 22 extending from the luminous bulb portion 10. A part of the side tube portion 22 will be formed into a sealing portion of the discharge lamp. The prepared glass pipe 50 can be secured while being held by a chuck 52. In this embodiment, the glass pipe 50 is held in the horizontal direction, but the glass pipe 50 can be held in the vertical direction. The glass pipe 50 is made of, for example, quartz glass, and the inner diameter and the glass thickness of the luminous bulb portion 10 of the prepared glass pipe 50 are 6 mm and 3 mm, respectively. The inner diameter and the length in the longitudinal direction of the side tube portion 22 are 3.4 mm and 250 mm, respectively.

The electrode assembly 40 includes a single tungsten rod (W rod) 16 serving as an electrode structure portion 42 and metal foils 24 and 24' joined to ends of the single W rod 16. The W rod 16 will be formed into respective electrode axes of a pair of electrodes in the discharge lamp. The length of the W rod 16 is, for example, about 20 mm, and the outer diameter $\phi$ thereof is, for example, about 0.4 mm. A portion 18 for melting and cutting that will be melted and cut in a subsequent process is in the center of the W rod 16. The portions outside the portion 18 for melting and cutting of the W rod 16 will be formed into the heads of the electrodes, and coils 14 are wound around these portions. The coils 14 have a function to reduce the temperature of the heads of the electrodes in the produced lamp. The outer diameter $\phi$ of the portion around which the coil 14 is wound is, for example, about 1.4 mm. In this embodiment, the electrode structure portion 42 that will be formed into a pair of electrodes is constituted by the single W rod, so that the electrode central axes 19 are matched from the beginning.

The W rod 16 is joined to the metal foils 24 and 24' by welding, and the metal foils 24 and 24' are made of molybdenum foils (Mo foils). The Mo foils 24 and 24' are, for example, rectangular flat sheets. The size of the Mo foils 24 and 24' can be set suitably. The Mo foils 24 and 24' are joined to the external leads (e.g., Mo rods) 30 by welding on the side opposite to the side that is joined to the W rod 16.

The electrode assembly 40 is inserted such that the electrode structure portion 42 is positioned in the luminous bulb portion 10 of the glass pipe 50. It was necessary to define the electrode distance D by alignment in the electrode assembly process in the prior art. However, in the method of this embodiment, the electrode distance D can be defined by the electrode structure portion 42 (or portion 18 for melting and cutting) of the electrode assembly 40, so that no constraints are imposed from alignment precision in the electrode assembly insertion process in the prior art. In other words, it is sufficient to place the electrode structure portion 42 in the inside of the luminous bulb portion 10. In the prior art, it was necessary to perform the insertion of the electrode assembly 40 twice, whereas in the method of this embodiment, it is sufficient to insert the single electrode assembly 40 only once, which simplifies the work.

Figure 1B:
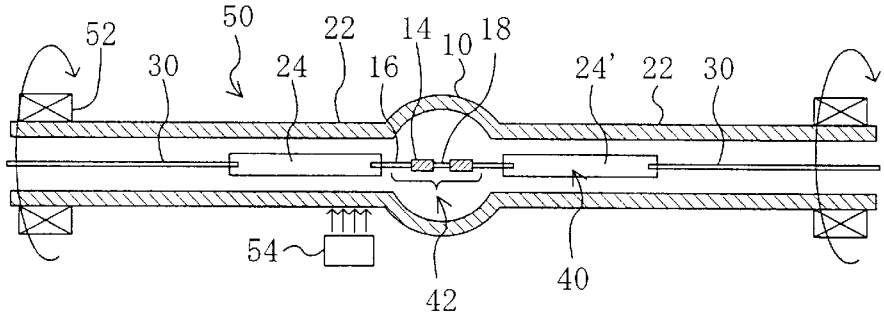

As shown in FIG. 1B, the sealing portions of the discharge lamp can be formed by attaching the side tube portion 22 of the glass pipe 50 to a part (the Mo foils) of the electrode assembly 40 (sealing portion formation process). The side tube portion 22 of the glass pipe 50 and the Mo foil 24 (or 24') can be attached (sealed) according to a known method. For example, the glass pipe 50 is put into a state where the pressure therein can be reduced, and then the pressure of the glass pipe 50 is reduced (e.g., 20 kPa). Under this reduced pressure, the side tube portion 22 of the glass pipe 50 is heated and softened with a burner 54 while the glass pipe 50 is rotated using a chuck 52. In this manner, the side tube portion 22 and the Mo foil 24 are attached, so that the sealing portion 20 can be formed.

After one sealing portion 20 is formed and before the other sealing portion 20' is formed, a luminous material of the discharge lamp is introduced to the inside of the luminous bulb portion 10 of the glass pipe 50. Thus, the luminous material can be introduced in a comparatively simple manner. The following approach is also possible. After the pair of sealing portions 20 and 20' are formed, a hole is made in the luminous bulb portion (luminous bulb) 10 of the glass pipe 50, and the luminous material is introduced through this hole, and the hole is closed.

In this embodiment, mercury (for example, in an amount of 150 to 200 mg/cm$^3$) as a luminous material, a rare gas with 5 to 20 kPa (e.g., argon) and a small amount of halogen are introduced into the inside of the luminous bulb portion 10. For example, bromine can be used as the halogen. The halogen is used not only in the form of a single substance (e.g., $Br_2$), but also in the form of halogen precursor. In this embodiment, the halogen is enclosed in the form of $CH_2Br_2$. The enclosed halogen (or halogen derived from the halogen precursor) serves to cause halogen cycles during lamp operation.

Figure 1C:
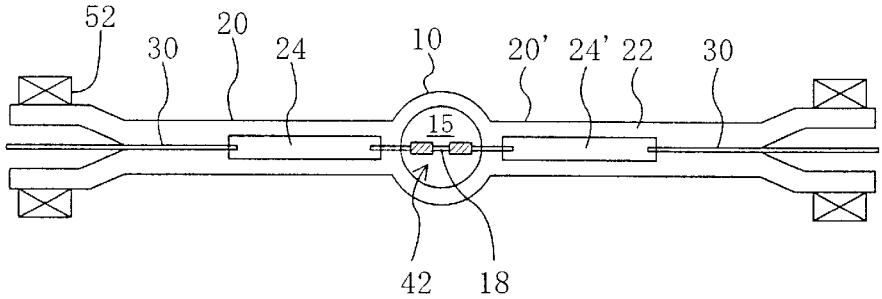
Figure 1D:
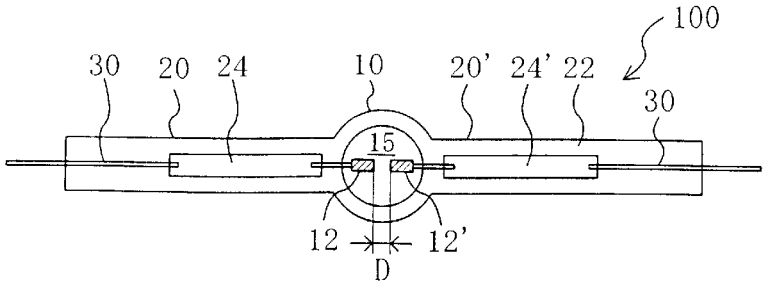

When the sealing formation process shown in FIG. 1B is performed to form the sealing portions (seal portions) 20 and 20', the luminous bulb 10 in which the electrode structure portion 42 in the hermetical inside 15 is arranged, as shown in FIG. 1C, can be obtained. Then, a part (a portion for melting and cutting) 18 of the electrode structure portion 42 positioned in the luminous bulb 10 is selectively melted and cut, so that a pair of electrodes having a predetermined electrode distance D can be formed (electrode formation process). Thereafter, the glass pipe 50 is cut such that the sealing portions 20 and 20' have a predetermined length. Thus, as shown in FIG. 1D, a discharge lamp 100 including the pair of electrodes 12 and 12' in the luminous bulb 10 can be obtained. In the discharge lamp 100 obtained by the production method of this embodiment, the electrode distance D can be defined without being affected by the alignment precision. Therefore, a discharge lamp having an electrode distance D of 1 mm or less that was very difficult to realize in the prior art can be obtained. It is preferable that the electrode distance D is 0.8 mm or less, more preferably 0.6 mm to 0.2 mm.

Figure 2A:
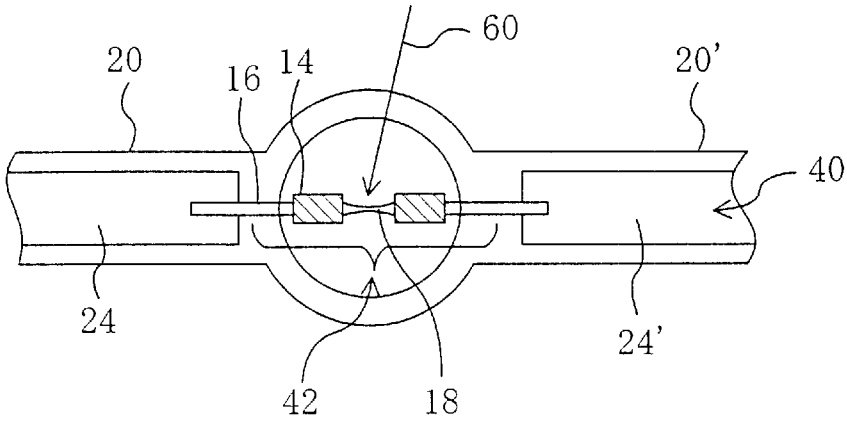
FIGS. 2A and 2B are partial enlarged views of a luminous bulb 10 for illustrating a laser irradiation process.
Figure 2B:
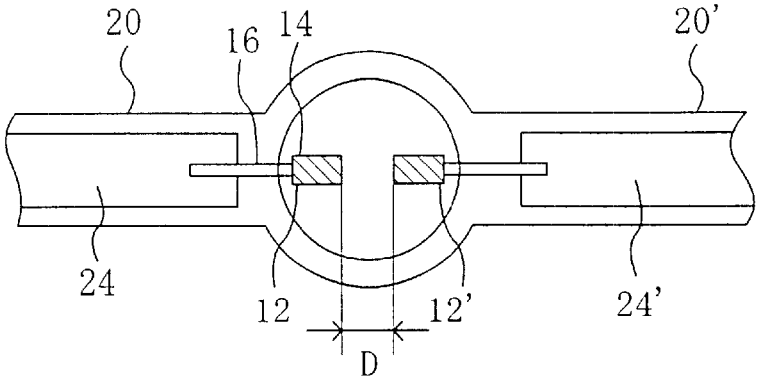

The electrode formation process can be performed by irradiating the portion 18 for melting and cutting with laser light 60 from the outside of the luminous bulb 10, as shown in FIGS. 2A and 2B. FIG. 2A schematically shows the laser light irradiation process, and FIG. 2B schematically shows a state in which the portion 18 for melting and cutting is melted and cut selectively and a pair of electrodes having an electrode distance D are formed.

As shown in FIG. 2A, the portion 18 for melting and cutting is irradiated with the laser light 60 from the outside of the luminous bulb 10, so that the portion 18 for melting and cutting of the electrode structure portion 42 can be heated and melted selectively. The irradiation conditions (output, spot diameter, irradiation time, etc.) of the laser light 60 can be determined suitably in accordance with the conditions of the portion 18 for melting and cutting of the W rod or the glass thickness of the luminous bulb 10 or the like. In some irradiation conditions, it is possible to control the shape of the heads of the electrodes 12 and 12' after melting and cutting to be, for example, spherical or of other various shapes by attaching a melted material to the heads of the electrodes 12 and 12'. Even with the electrodes 12 and 12' having a ball-shaped head as a result of welding, there is no particular problem in causing discharge.

In this embodiment, in order to facilitate melting and cutting with the laser light 60, the W rod 16 is processed such that the diameter thereof becomes smaller toward the center of the portion 18 for melting and cutting. Japanese Laid-Open Patent Publication No. 11-40058 discloses a technique of producing a pair of electrodes by stretching a single rod for cutting. In this technique, for the purpose of facilitating cutting, a vacuum heat treatment is performed to cause weak recrystallization in the portion at which the W rod is to be cut. In this embodiment, it is not necessary to perform such a vacuum heat treatment for recrystallization to the portion 18 for melting and cutting, and the W rod of this embodiment does not include a portion in which weak recrystallization is caused. Although the process procedure becomes complicated with an increased number of processes, the W rod including such a weakly recrystallized portion can be used.

In this embodiment, the coils 14 are wound around on both sides of the portion 18 for melting and cutting in such manner that the portion 18 for melting and cutting is sandwiched by the coils 14. Therefore, even if the temperature of the portion 18 for melting and cutting is increased during irradiation of the laser light 60, it is possible to alleviate the temperature increase of the other portions (near the bases of the electrodes 12 and 12') of the W rods 16 by the cooling effect of the coils 14. The portions of the W rods 16 in the bases of the electrodes 12 and 12' are sealed by the sealing portions 20 and 20'. Therefore, when the temperature of these portions of the W rods 16 becomes too high, cracks may be generated in the sealing portions because of the difference in the coefficient of thermal expansion between the W rods 16 and the quartz glass of the sealing portions (20, 20'). In this embodiment, the coils 14 are provided on both sides of the portion 18 for melting and cutting, so that such generation of cracks can be prevented or reduced. To prevent generation of cracks more positively, it is preferable to perform irradiation of the laser light 60 while cooling the W rods 16 (near the bases of the electrodes 12 and 12') in the sealing portions 20 and 20'.

Figure 3A:
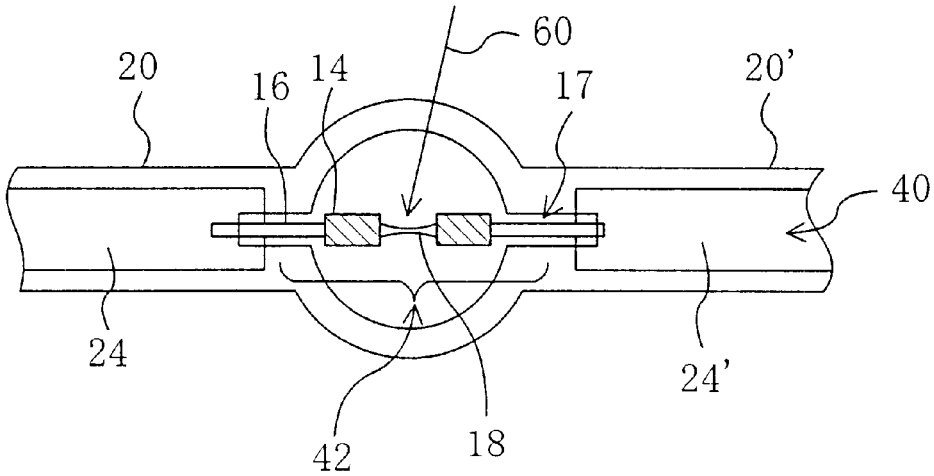
FIGS. 3A and 3B are partial enlarged views of a luminous bulb 10 for illustrating a variation of the laser irradiation process.

Furthermore, the sealing portion formation process shown in FIG. 1B can be performed as follows. A gap 17 is formed between the W rod 16 and the sealing portions 20 and 20' (preliminary sealing or preliminary attachment), as shown in FIG. 3A, and then irradiation of the laser light 60 is performed. With this configuration, the gap 17 can prevent cracks from being generated in the sealing portions 20 and 20' more reliably, even if the W rod 16 is expanded by heating during laser irradiation. It is preferable that the gap 17 has a length that can prevent the W rod 16 from being in contact with the sealing portions 20 and 20' when the W rod 16 is expanded by heating during laser irradiation. However, if it is ensured that no cracks will be generated, the gap can be a length that allows a contact with the sealing portions 20 and 20' at expansion.

Figure 3B:
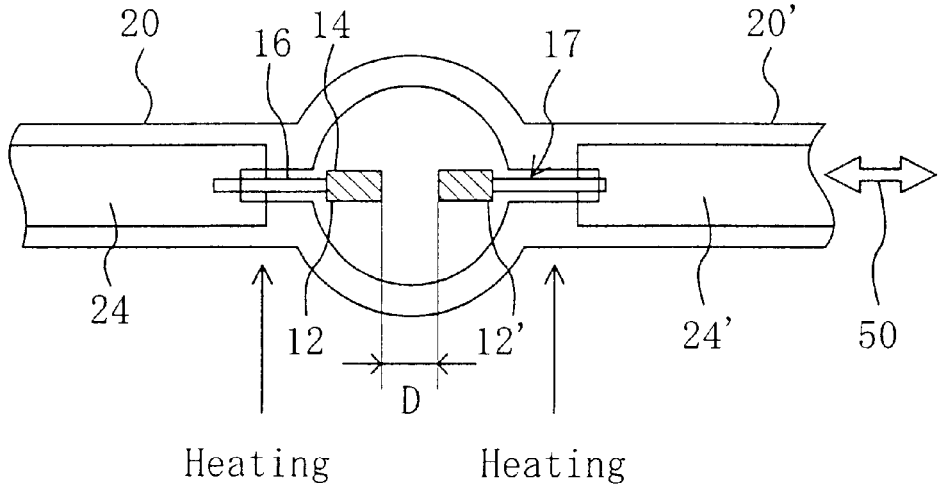
Figure 4:
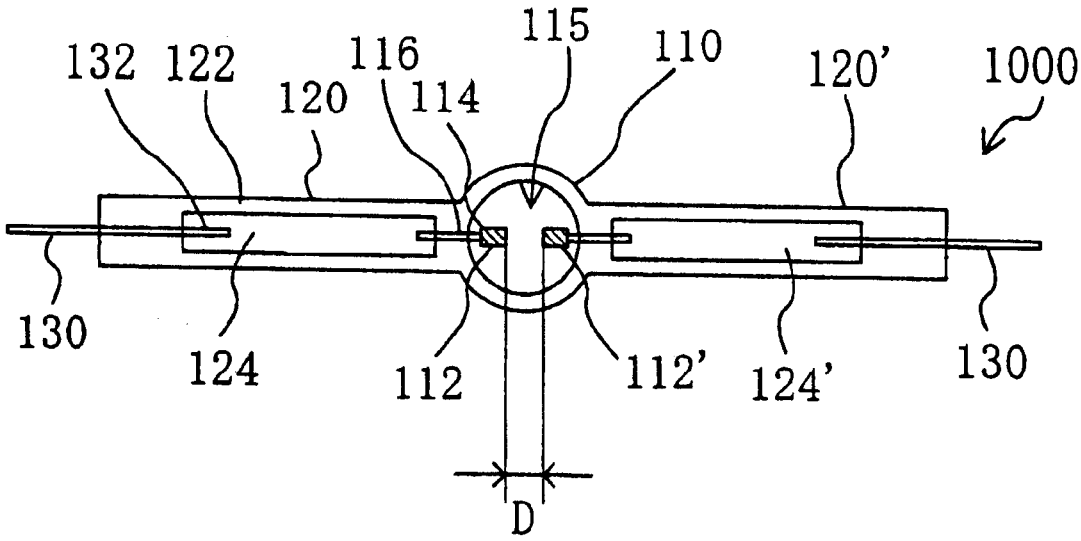
FIG. 4 is a schematic view of the configuration of a conventional ultra high pressure mercury lamp 1000.
Figure 5A:
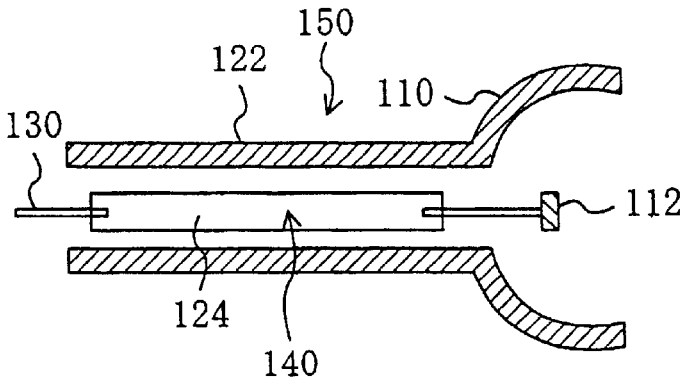
FIGS. 5A to 5C are cross-sectional views for illustrating a method for producing the conventional ultra high pressure mercury lamp 1000.
Figure 5B:
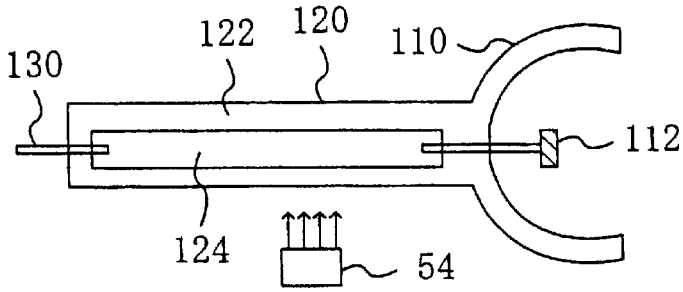
PRIOR ART FIG. 5B
Figure 5C:
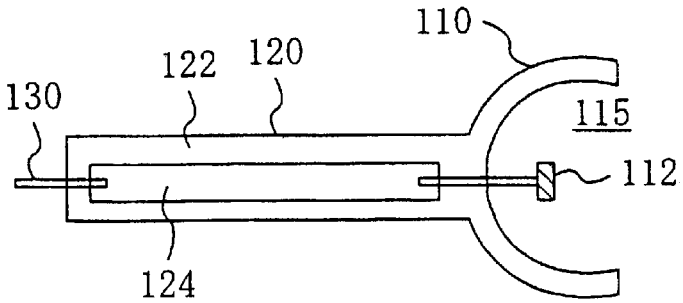
PRIOR ART FIG. 5C

After the pair of electrodes 12 and 12' are formed by irradiation of the laser light 60 as shown in FIG. 3A, parts (base portions) of the electrodes 12 and 12' can be attached to the sealing portions 20 and 20' so as to fill the gap 17. More specifically, as shown in FIG. 3B, the gap 17 can be filled by heating the portions of the sealing portions 20 and 20' positioned around the base portions of the electrodes 12 and 12'. In this stage, the electrode distance D can be subjected to fine adjustment by applying a stress 50 along the longitudinal direction of the lamp. In view of mass production, it is not efficient to perform fine adjustment with respect to lamps one by one. However, the fine adjustment of the electrode distance D is preferable to control the electrode distance D more precisely or to adjust the electrode distance D having a slight deviation from the standard to be within the standard. When the gap 17 is present, the electrode (for example, 12') can be moved easily, and the fine adjustment can be performed easily. The reason for this is as follows. When the base of the electrode (12') and the sealing portion (20') are attached and the gap 17 is not present, then it is difficult to heat from the outside in this stage until the glass attached to the base of the electrode (12') is melted. In addition, even if the stress 50 is applied in the state where the glass only on the surface of the sealing portion (20') is melted, the melted portion of the glass is deformed, but it is difficult to perform fine adjustment satisfactorily.

In irradiation of the laser light 60, when the laser light 60 passes through the glass of the luminous bulb 10, strain may occur in the glass of the luminous bulb 10. Therefore, it is preferable to perform the electrode formation process while rotating the luminous bulb 10 during the laser light irradiation process so as to prevent the strain from being concentrated on a certain portion. The rotation of the luminous bulb 10 can be performed easily, because the glass pipe 50 can be rotated by the chuck 52 holding the glass pipe 50. The rotation of the luminous bulb 10 can be performed relatively with respect to the laser light 60, and therefore the laser light source of the laser light 60 can be rotated with the luminous bulb 10 as the center. Instead of rotating the luminous bulb 10, a plurality of laser light 60 having a comparatively low output using a plurality of laser light sources can be used for irradiation.

It was speculated that when the portion 18 for melting and cutting of the W rod 16 is heated and melted by the laser light 60, tungsten in the portion 18 for melting and cutting evaporates, which causes blackening. However, when the inventors of the present invention made experiments, and the portion 18 for melting and cutting is irradiated with the laser light 60 from three directions, the luminous bulb 10 was not blackened. The reason for this seems that a small amount of halogen enclosed in the luminous bulb 10 reacts with evaporated tungsten to cause halogen cycles. Even if the luminous bulb 10 should be blackened by laser irradiation to the portion 18 for melting and cutting, the inside of the luminous bulb 10 can be cleaned thereafter by causing halogen cycles using enclosed halogen. This cleaning process can be performed, for example, by vacuum-baking the luminous bulb 10 to cause halogen cycles with halogen.

In the above embodiments, the electrode formation process is performed by irradiation of the laser light 60. However, instead, the electrode formation process can be performed by allowing current to flow through the electrode assembly 40. For example, comparatively large current is allowed to flow through the electrode assembly 40 using each of the pair of external leads 30 of the electrode assembly 40 as a terminal to heat and melt the portion 18 for melting and cutting of the electrode structure portion 42 selectively. It is also preferable to process the W rod 16 such that the diameter of the W rod 16 at the portion 18 for melting and cutting is small to raise the electrical resistance at that portion. The laser irradiation can be combined with the supply of current.

In this embodiment, the portion 18 for melting and cutting is provided as a part of the W rod 16. However, since the portion 18 for melting and cutting positioned between the pair of electrodes serves as a spacer that defines the electrode distance D, in order to exhibit this function more definitely, different materials can be used for the portion 18 for melting and cutting and the W rod so as to melt and cut the portion 18 for melting and cutting more easily. For example, the portion 18 for melting and cutting can be made of a material that can be melted and cut easily by irradiation of the laser 60 or a material having a large resistance so as to be melted and cut easily by large current. It is also possible to mix another substance selectively in the portion 18 for melting and cutting of the W rod 16. In the case where the portion 18 for melting and cutting is made of a different material from that of the W rod 16, it is preferable that the material constituting the portion 18 for melting and cutting does not affect the discharge characteristics of the lamp. Furthermore, the material can be the same as the luminous material. In this case, since the melted substance remains in the luminous bulb 10 as the luminous material, there is an advantage that introduction of the luminous material can be omitted.

In irradiation of the laser light 60 or allowing large current to flow, it is preferable to perform the electrode formation process while cooling the luminous bulb 10 so that the temperature of the luminous bulb 10 is significantly increased. This is because when the temperature of the luminous bulb 10 is significantly increased, the volume of the filled substances (mercury, Ar or the like) in the luminous bulb 10 expand so that the luminous bulb may be damaged. The luminous bulb 10 can be cooled by using, for example, nitrogen ($N_2$) or water.

In the production method of this embodiment, the portion 18 for melting and cutting of the electrode structure portion 42 of the electrode assembly 40 is melted and cut selectively to form the pair of electrodes 12 and 12' in the luminous bulb 10. Therefore, the distance D between the pair of electrodes can be defined with a higher precision than that in the prior art. As a result, a discharge lamp 100 having a shorter electrode distance (e.g., 1 mm or less) that could not be realized in the prior art.

The lamp 100 obtained by the production method of this embodiment can be attached to an image projection apparatus such as a liquid crystal projector or a projector using a DMD and can be used as the light source for the projector. In addition to the light source for projectors, the discharge lamp 100 in the above embodiments also can be used as the light source for ultraviolet ray steppers, the light source for sports stadiums, or the light source for headlights for automobiles.

In the above embodiments, the w rod 16 in which the electrode central axes 19 of the pair of electrodes coincides with each other is used. However, the present invention is not limited thereto, and the W rod 16 in which the electrode central axes 19 of the pair of electrodes are not on the same axis can be used for the electrode formation process. Furthermore, in the above embodiments, the electrode assembly 40 has a configuration in which the Mo foils 24 and 24' are joined to ends of the W rod 16. However, an electrode assembly in which the Mo foils 24 is made of the W rod 16 as well can be used. More specifically, the single W rod can be formed into an electrode assembly. In this configuration, the external leads 30 can be constituted by the W rod as well.

Furthermore, in the above embodiments, the case where the mercury vapor pressure is about 20 MPa (so-called ultra high pressure mercury lamp) has been described. However, the present invention can apply to a high-pressure mercury lamp where the mercury vapor pressure is about 1 MPa or a low-pressure mercury lamp where the mercury vapor pressure is about 1 kPa. Moreover, the present invention can apply to other discharge lamps than mercury lamps. For example, the present invention can apply to a discharge lamp such as a metal halide lamp enclosing a metal halide. The present invention can apply preferably to a lamp of a short arc type where the electrode distance D (arc length) is comparatively short. However, the present invention is not limited thereto, and can be a lamp having a comparatively long electrode distance D. The discharge lamp 100 obtained by the above embodiments can be used by either alternating current lighting or direct current lighting.

According to the present invention, a part of the electrode structure portion of the electrode assembly is melted and cut selectively to form a pair of electrodes in the luminous bulb. Therefore, the distance between the pair of electrodes can be defined with a higher precision than that in the prior art. As a result, a discharge lamp having a shorter electrode distance (e.g., 1 mm or less) that could not be realized in the prior art can be produced and provided.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method for preparing a discharge lamp comprising the steps of:

preparing a glass pipe for a discharge lamp having a luminous bulb portion and a side tube portion, and a single electrode assembly including an electrode structure portion that will be formed into a pair of electrodes of the discharge lamp;

inserting the single electrode assembly into the glass pipe for a discharge lamp such that the electrode structure portion of the single electrode assembly is positioned in the luminous bulb portion of the glass pipe for a discharge lamp;

forming a luminous bulb in which the electrode structure portion is arranged inside by attaching the side tube portion of the glass pipe for a discharge lamp to a part of the single electrode assembly; and forming a pair of electrodes in the luminous bulb by melting and cutting a part of the electrode structure portion selectively, wherein the step of forming the pair of electrodes is performed while cooling the luminous bulb.

2. The method for producing a discharge lamp according to claim 1, wherein the electrode structure portion has a configuration in which the pair of electrodes of the discharge lamp are on a same axis.

3. The method for producing a discharge lamp according to claim 1, further comprising the step of filling a luminous material into the luminous bulb portion of the glass pipe for a discharge lamp.

4. The method for producing a discharge lamp according to claim 1, further comprising the step of filling halogen or halogen precursor into the luminous bulb portion, wherein after melting and cutting the part of the electrode structure portion, the step of cleaning an inside of the luminous bulb in which the pair of electrodes are formed is performed by the halogen or halogen derived from the halogen precursor.

5. The method for producing a discharge lamp according to claim 4, wherein the step of cleaning the inside of the luminous bulb comprises the step of vacuum-baking the luminous bulb to cause halogen cycles with the halogen.

6. The method for producing a discharge lamp according to claim 1, wherein the single electrode assembly comprises a single tungsten rod serving as the electrode structure portion and metal foils joined to both ends of the single tungsten rod.

7. The method for producing a discharge lamp according to claim 6, wherein coils are wound around both side of a part of the single tungsten rod that is to be melted and cut selectively.

8. The method for producing a discharge lamp according to claim 1, wherein the step of forming the pair of electrodes is performed by irradiation of laser light from an outside of the luminous bulb.

9. The method for producing a discharge lamp according to claim 8, wherein the irradiation of the laser light is performed by rotating the luminous bulb portion relatively.

10. The method for producing a discharge lamp according to claim 8, wherein the step of forming the pair of electrodes is performed while cooling portions that will be formed into base portions of the pair of electrodes when the electrode structure portion is formed into the pair of electrodes.

11. The method for producing a discharge lamp according to claim 1, wherein the step of forming the pair of electrodes is performed by allowing current to flow through the single electrode assembly.

12. The method for producing a discharge lamp according to claim 1, wherein the step of attaching the side tube portion to a part of the single electrode assembly comprises the step of preliminary attaching the side tube portion to the part of the electrode assembly such that a gap is generated between the electrode structure portion and the side tube portion, and after the step of the preliminary attachment, the part of the electrode structure portion is melted and cut selectively.

13. The method for producing a discharge lamp according to claim 12, wherein the gap has a length that can prevent the electrode structure portion from being in contact with the side tube portion, even if the electrode structure portion is expanded by heat during melting and cutting.

14. The method for producing a discharge lamp according to claim 12, further comprising the step of melting and cutting the part of the electrode structure portion selectively and then adjusting an electrode distance between the pair of electrodes obtained by melting and cutting, after the step of the preliminary attachment.

15. The method for producing a discharge lamp according to claim 12, further comprising the step of attaching a part of each of the pair of electrodes to the side tube portion so as to fill the gap, after the part of the electrode structure portion is melted and cut selectively.

16. A discharge lamp comprising a luminous bulb in which a luminous material is enclosed and a pair of electrodes are opposed to each other in the luminous bulb; and a pair of sealing portions for sealing a pair of metal foils electrically connected to the pair of electrodes, respectively, the discharge lamp being produced by a method comprising the steps of:

preparing a glass pipe for a discharge lamp having a luminous bulb portion and a side tube portion, and a single electrode assembly including an electrode structure portion that will be formed into a pair of electrodes of a discharge lamp;

inserting the single electrode assembly into the glass pipe for a discharge lamp such that the electrode structure portion of the single electrode assembly is positioned in the luminous bulb portion of the glass pipe for a discharge lamp;

forming a luminous bulb in which the electrode structure portion is arranged inside by attaching the side tube portion of the glass pipe for a discharge lamp to a part of the single electrode assembly; and forming a pair of electrodes in the luminous bulb by melting and cutting a part of the electrode structure portion selectively, wherein an electrode distance between the pair of electrodes is 1 mm or less, and wherein the step of forming the pair of electrodes is performed while cooling the luminous bulb.

* * * * *